US008897908B2

(12) United States Patent
Katano et al.

(10) Patent No.: US 8,897,908 B2
(45) Date of Patent: Nov. 25, 2014

(54) SEWING DATA CREATION APPARATUS, SEWING DATA CREATION METHOD, AND COMPUTER PROGRAM PRODUCT

(75) Inventors: Tomotaka Katano, Nagoya (JP); Chiyo Koga, Nagoya (JP); Takashi Hirata, Nagoya (JP); Satoko Hishida, Nagoya (JP); Masayuki Hori, Gifu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 409 days.

(21) Appl. No.: 13/414,311

(22) Filed: Mar. 7, 2012

(65) Prior Publication Data

US 2012/0239180 A1 Sep. 20, 2012

(30) Foreign Application Priority Data

Mar. 16, 2011 (JP) ..... 2011-057331

(51) Int. Cl.
*D05C 5/02* (2006.01)
*D05B 19/10* (2006.01)
*D05C 5/04* (2006.01)

(52) U.S. Cl.
CPC . *D05B 19/10* (2013.01); *D05C 5/04* (2013.01)
USPC ..... 700/138; 112/470.01

(58) Field of Classification Search
USPC ..... 700/136–138; 112/102.5, 470.01, 112/470.04, 470.06, 475.18, 475.19
See application file for complete search history.

(56) References Cited

U.S. PATENT DOCUMENTS 5,410,976 A * 5/1995 Matsubara ..... 112/102.5
5,880,963 A 3/1999 Futamura
2011/0218665 A1 9/2011 Katano et al.

FOREIGN PATENT DOCUMENTS

JP A-62-276069 11/1987
JP A-7-150409 6/1995
JP A-9-122367 5/1997
JP A-2003-41477 2/2003
JP A-2011-177357 9/2011

OTHER PUBLICATIONS

May 10, 2013 Office Action issued in U.S. Appl. No. 13/026,819.
U.S. Appl. No. 13/026,819 filed in the name of Katano et al. on Feb. 14, 2011.

* cited by examiner

*Primary Examiner* — Nathan Durham
(74) *Attorney, Agent, or Firm* — Oliff PLC

(57) ABSTRACT

A sewing data creation apparatus includes an area specification portion that specifies at least one area in which a plurality of stitches are to be formed and a sewing data creation portion that creates sewing data for forming the plurality of stitches in each of the specified at least one area and for forming an overlapping portion in a case where the specified at least one area includes a first area and a second area. The overlapping portion is a region in which at least one of the first area and the second area is enlarged in a direction that extends across a boundary line, such that a portion of the plurality of stitches to be formed in the first area is one of intersected and overlapped by a portion of the plurality of stitches to be formed in the second area.

7 Claims, 25 Drawing Sheets

FIG. 10

| LAYER | STITCHING DIRECTION (DEGREES) |
|---|---|
| 1 | 90 |
| 2 | 0 |
| 3 | 45 |
| 4 | 135 |
| ⋮ | ⋮ |

SEWING DATA CREATION APPARATUS, SEWING DATA CREATION METHOD, AND COMPUTER PROGRAM PRODUCT

CROSS-REFERENCE TO RELATED APPLICATION

This application claims priority to Japanese Patent Application No. 2011-057331, filed Mar. 16, 2011, the content of which is hereby incorporated herein by reference in its entirety.

BACKGROUND

The present disclosure relates to a sewing data creation apparatus, a sewing data creation method, and a computer program product that create sewing data for sewing an embroidery pattern using an embroidery sewing machine.

A sewing data creation apparatus is known that creates sewing data for sewing an embroidery pattern on a work cloth. The sewing data creation apparatus generally creates the sewing data as hereinafter described. First, a shape of an embroidery area is determined automatically based on an image of a desired embroidery design. Next, the sewing data are created for stitches of a type that is designated by a user and that are to be formed in an area that is enclosed by an external outline that contains an external outline of the embroidery area.

A method for manufacturing an ornamental material is also known that produces an embroidered object by forming one of stitches and an embroidery pattern in a water-soluble material, then removing the water-soluble material by dissolving it. The embroidered object is a sewn object whose shape can be maintained by the stitches of the embroidery pattern alone.

SUMMARY

The sewing data that are created by the known sewing data creation apparatus that is described above are not created on the assumption that the embroidered object will be formed by the stitches of the embroidery pattern alone. Therefore, in a case where, based on this kind of embroidery data, an embroidery pattern is formed in a water-soluble material that is the object of the sewing, the stitches of the embroidery pattern come unraveled when the water-soluble material is removed by being dissolved. In this case, the embroidered object cannot be produced.

Various exemplary embodiments of the broad principles derived herein provide a sewing data creation apparatus, a sewing data creation method, and a computer program product that are capable of creating sewing data for forming stitches that are suited to forming an embroidered object.

Embodiments provide a sewing data creation apparatus that includes an area specification portion and a sewing data creation portion. The area specification portion specifies at least one area in which a plurality of stitches are to be formed, each of the at least one area including a plurality of locations where two stitches that extend in different directions intersect. The sewing data creation portion creates sewing data for forming the plurality of stitches in each of the at least one area specified by the area specification portion. The sewing data creation portion creating sewing data for forming an overlapping portion in a case where the at least one area specified by the area specification portion includes a first area and a second area. The first area and the second area are two areas that are contiguous and that are to be sewn with different types of threads. The overlapping portion is a region in which at least one of the first area and the second area is enlarged in a direction that extends across a boundary line between the first area and the second area, such that a portion of the plurality of stitches to be formed in the first area is one of intersected and overlapped by a portion of the plurality of stitches to be formed in the second area.

Embodiments provide also method of creating sewing data creation method that is processed by a computer includes the steps of specifying at least one area in which a plurality of stitches are to be formed, each of the at least one area including a plurality of locations where two stitches that extend in different directions intersect, and creating sewing data for forming the plurality of stitches in each of the specified at least one area specified and for forming an overlapping portion in a case where the specified at least one area specified includes a first area and a second area. The first area and the second area are two areas that are contiguous and that are to be sewn with different types of threads. The overlapping portion is a region in which at least one of the first area and the second area is enlarged in a direction that extends across a boundary line between the first area and the second area, such that a portion of the plurality of stitches to be formed in the first area is one of intersected and overlapped by a portion of the plurality of stitches to be formed in the second area.

Embodiments further provide a non-transitory computer-readable medium storing a control program executable on a sewing data creation apparatus. The program includes instructions that cause a computer of the sewing data creation apparatus to perform the steps of specifying at least one area in which a plurality of stitches are to be formed, each of the at least one area including a plurality of locations where two stitches that extend in different directions intersect, and creating sewing data for forming the plurality of stitches in each of the specified at least one area specified and for forming an overlapping portion in a case where the specified at least one area specified includes a first area and a second area. The first area and the second area are two areas that are contiguous and that are to be sewn with different types of threads. The overlapping portion is a region in which at least one of the first area and the second area is enlarged in a direction that extends across a boundary line between the first area and the second area, such that a portion of the plurality of stitches to be formed in the first area is one of intersected and overlapped by a portion of the plurality of stitches to be formed in the second area.

BRIEF DESCRIPTION OF THE DRAWINGS

Exemplary embodiments will be described below in detail with reference to the accompanying drawings in which:

FIG. 10 is an explanatory figure that shows an example of a stitching direction table;

DETAILED DESCRIPTION

Figure 1:
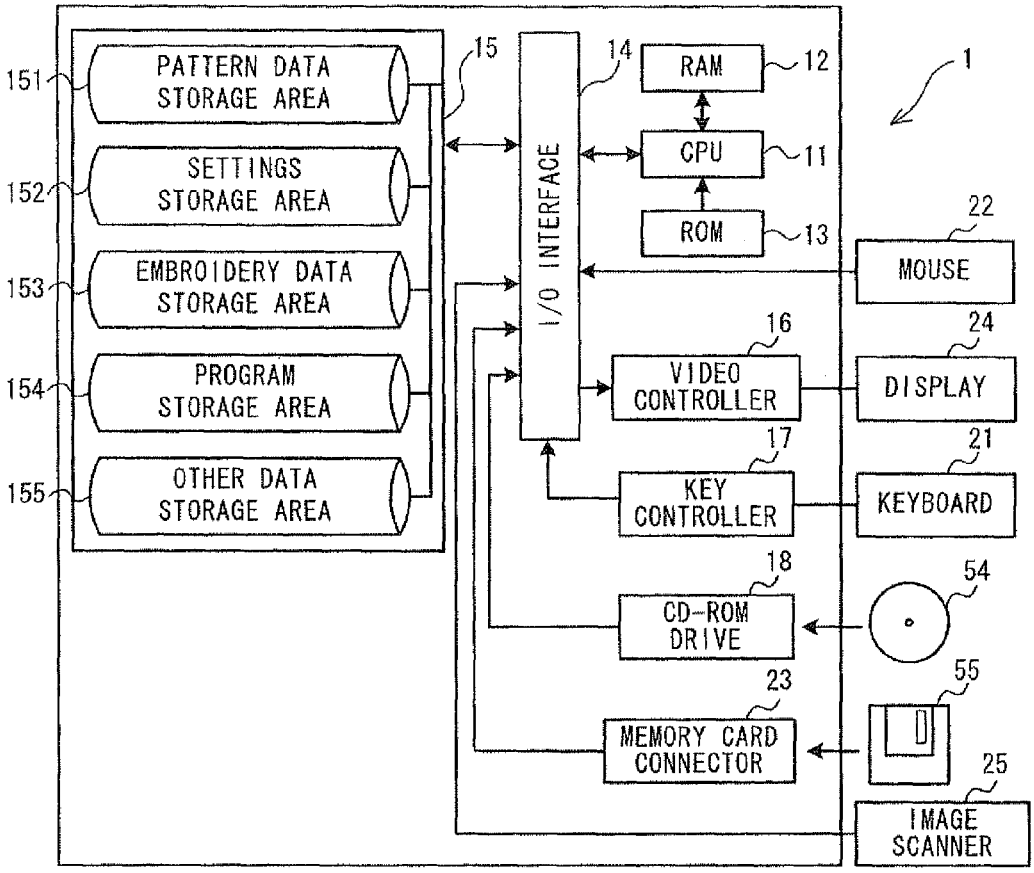
FIG. 1 is a block diagram that shows an electrical configuration of an embroidery data creation apparatus.

Hereinafter, embodiments of the present disclosure will be explained with reference to the drawings.

A first embodiment of the present disclosure will be explained with reference to FIGS. 1 to 17. First, a configuration of an embroidery data creation apparatus 1 will be explained with reference to FIG. 1. The embroidery data creation apparatus 1 is a apparatus that creates embroidery data for the sewing of an embroidery pattern in an object of sewing by an embroidery sewing machine 3 (refer to FIG. 2) that will be described later. The object of sewing may be, for example, a work cloth (not shown in the drawings), a water-soluble sheet (not shown in the drawings), or the like.

The embroidery data creation apparatus 1 is a general-purpose type of apparatus such as personal computer or the like, for example. As shown in FIG. 1, a CPU 11 is provided that is a controller that performs control of the embroidery data creation apparatus 1. A RAM 12, a ROM 13, and an input/output (I/O) interface 14 are connected to the CPU 11. The RAM 12 can store various types of data temporarily. The ROM 13 can store a BIOS and the like. The I/O interface 14 performs mediation of data transfers. A hard disk drive (HDD) 15, a mouse 22 that is an input device, a video controller 16, a key controller 17, a CD-ROM drive 18, a memory card connector 23, and an image scanner 25 are connected to the I/O interface 14. The embroidery data creation apparatus 1 may also include an external interface for connecting to one of an external device and a network, although this is not shown in FIG. 1.

A display 24 that is a display device is connected to the video controller 16. A keyboard 21 that is an input device is connected to the key controller 17. A CD-ROM 54 can be inserted into the CD-ROM drive 18. For example, when an embroidery data creation program is set up, the CD-ROM 54 in which the embroidery data creation program is stored is inserted into the CD-ROM drive 18. Then, the embroidery data creation program is read and stored in a program storage area 154 of the HDD 15. A memory card 55 can be connected to the memory card connector 23, and reading of information from the memory card 55 and writing of information to the memory card 55 can be performed.

Storage areas of the HDD 15 will be explained. As shown in FIG. 1, the HDD 15 is provided with a plurality of storage areas that include a pattern data storage area 151, a settings storage area 152, an embroidery data storage area 153, the program storage area 154, and an other data storage area 155. Pattern data may be stored in the pattern data storage area 151. The pattern data are data that describe a pattern to be embroidered, such as an area, characters, a design, and the like. In the present embodiment, the pattern data are at least one of image data that describe a pattern and embroidery data for sewing a pattern. The embroidery data are data that may be used when the embroidery sewing machine 3 performs embroidering. The embroidery data include positions (coordinates) of needle drop points and their sewing order, as well as data that pertain to the colors of the embroidery threads. Hereinafter, a pattern for which the pattern data are stored in the pattern data storage area 151 is called a built-in pattern.

Various types of setting values that are used by embroidery data creation processing that will be described later are stored in the settings storage area 152. Embroidery data that have been created by the executing of the embroidery data creation program by the CPU 11 are stored in the embroidery data storage area 153. A plurality of programs that include the embroidery data creation program that is executed by the CPU 11 are stored in the program storage area 154. Initial values and setting values for various types of parameters, for example, are stored in the other data storage area 155. Note that in a case where the embroidery data creation apparatus 1 is not provided with the HDD 15, the embroidery data creation program may also be stored in the ROM 13.

Figure 2:
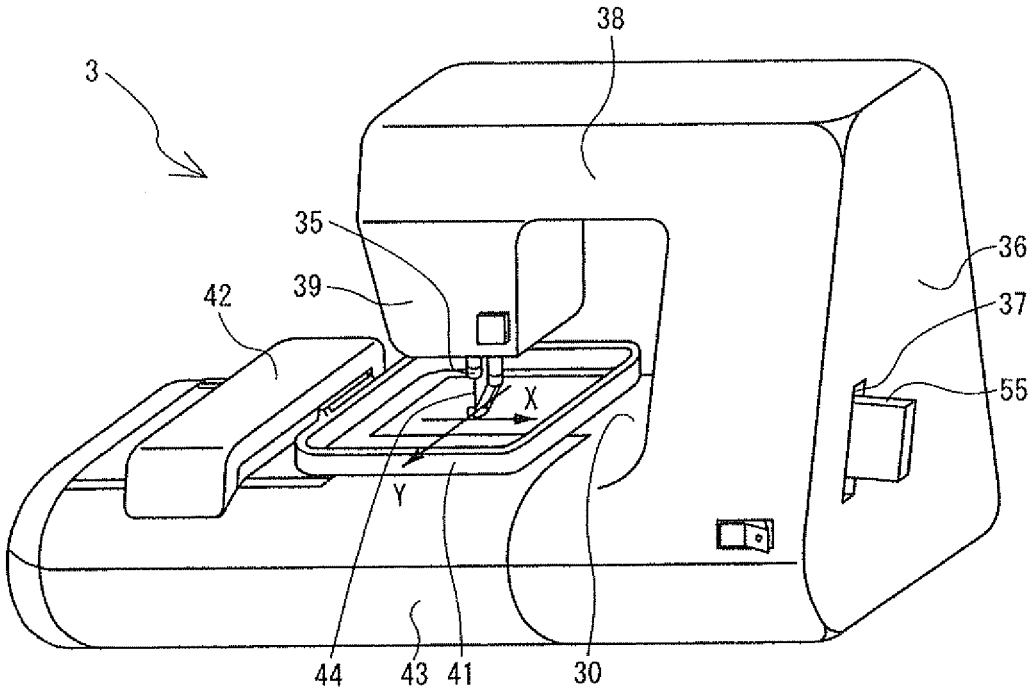
FIG. 2 is an exterior view of an embroidery sewing machine.

The embroidery sewing machine 3 will be explained briefly with reference to FIG. 2. The embroidery sewing machine 3 can sew an embroidery pattern based on the embroidery data that are created by the embroidery data creation apparatus 1. As shown in FIG. 2, the embroidery sewing machine 3 has a bed 30, a pillar 36, an arm 38, and a head 39. The bed 30 extends as the long direction of the left-right direction in relation to the person doing the sewing. The pillar 36 extends upward from the right end of the bed 30. The arm 38 extends toward the left from the upper end of the pillar 36. The head 39 is attached to the left end of the arm 38.

An embroidery frame 41 that can hold the work cloth (not shown in the drawings) on which the embroidering is performed can be disposed on the bed 30. The embroidery frame 41 can be moved by a Y direction drive portion 42 and an X direction drive mechanism (not shown in the drawings) to a specified position that is indicated by XY coordinates that are specific to the embroidery data creation apparatus 1. The X direction drive mechanism is contained within a body case 43. In coordination with the moving of the embroidery frame 41, an embroidery pattern can be formed on the work cloth by the driving of a shuttle mechanism (not shown in the drawings) and a needle bar 35, in which a sewing needle 44 is mounted. The Y direction drive portion 42, the X direction drive mechanism, and the needle bar 35 are controlled by a control device (not shown in the drawings) that is built into the embroidery sewing machine 3. The control device is configured from a microcomputer and the like.

A memory card slot 37 can be installed in a side face of the pillar 36 of the embroidery sewing machine 3. The memory card 55 can be mounted in and removed from the memory card slot 37. For example, the embroidery data that have been created by the embroidery data creation apparatus 1 may be stored in the memory card 55 through the memory card connector 23. The memory card 55 is then mounted in the memory card slot 37, the stored embroidery data are read, and the embroidery data are stored in the embroidery sewing machine 3. The control device of the embroidery sewing machine 3 (not shown in the drawings) automatically controls the embroidery operation by the elements that are described above, based on the embroidery data that are supplied from the memory card 55. Thus the embroidery sewing machine 3 is able to sew an embroidery pattern based on the embroidery data that have been created by the embroidery data creation apparatus 1.

Figure 3:
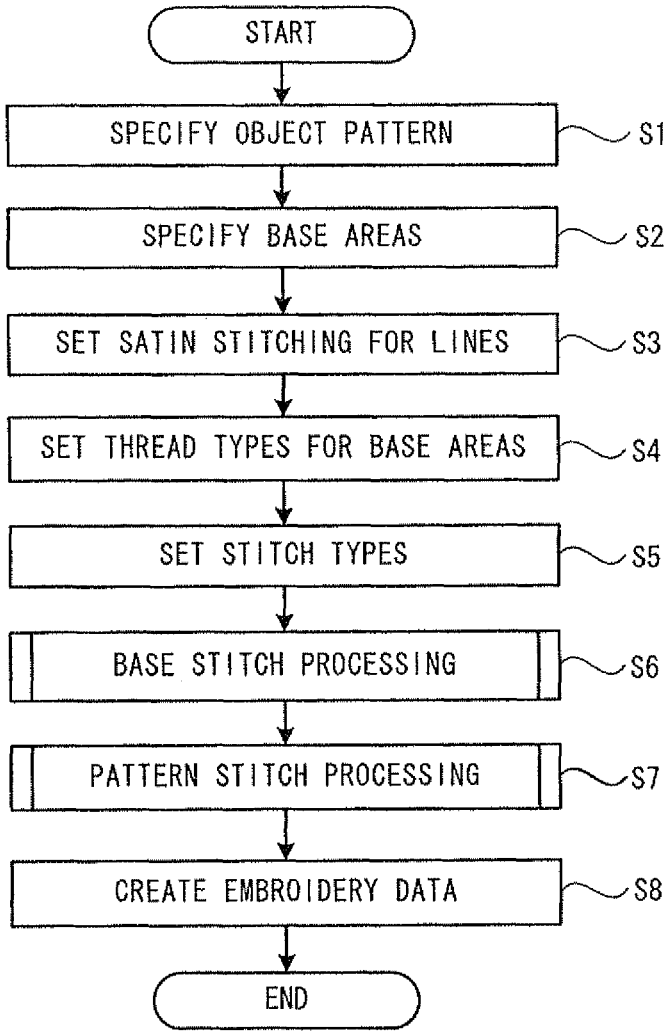
FIG. 3 is a flowchart of main processing that is performed by the embroidery data creation apparatus.

Main processing that is performed by the embroidery data creation apparatus 1 will be explained with reference to FIGS. 3 to 17. When a user inputs a command to start processing, the main processing that is shown in FIG. 3 is performed by the CPU 11 in accordance with the embroidery data creation program that is stored in the HDD 15 in FIG. 1.

First, an object pattern is specified that is a pattern that will be the object of the processing (Step S1). The object pattern according to the present embodiment is described by at least one of a line, an area, and a pattern. At Step S1, a list of the built-in patterns may be displayed on the display 24, for example, and a built-in pattern that is selected from among the built-in patterns is specified as the object pattern. A shape (a circle, a square, or the like) that the user has input using the mouse 22, for example, may also be specified as the object pattern. An image that is described by image data that have been acquired using the image scanner 25, for example, may also be specified as the object pattern. Note that the object pattern may also include a plurality of patterns. In a case where the specified object pattern is a built-in pattern, the pattern data that are stored in the pattern data storage area 151 of the HDD 15 are read and are stored in the RAM 12 as object pattern data. In a case where the object pattern is one of a shape that has been input and an image that has been acquired from the image scanner 25, one of the data that describe the shape and the image data for the image are stored in the RAM 12 as the object pattern data. The position of the object pattern in the XY coordinate system of the embroidery sewing machine 3 is also specified.

Next, at least one base area is specified, and data that describe the specified base area are stored in the RAM 12 (Step S2). The base area is an area in which base stitches to be formed. The base stitches are a plurality of stitches that include a plurality of intersection points that are locations where two stitches that extend in different directions intersect. The base stitches have a plurality of the intersection points. Therefore, the shapes of the base stitches can be maintained even in a case where the object of sewing is removed after the sewing has been performed in accordance with the created embroidery data. The base area is one of an area that the user has designated and an area inside a contour line that contains a contour line of the object pattern (hereinafter simply called the area inside the contour line). At Step S2, the object pattern may be displayed on the display 24, for example, and the user can use the mouse 22 to input the contour line of an area that the user wants to designate as the base area.

Figure 8:
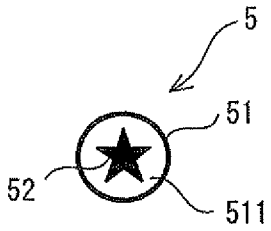
FIG. 8 is an explanatory figure of a pattern that is an example of an object pattern.
Figure 9:
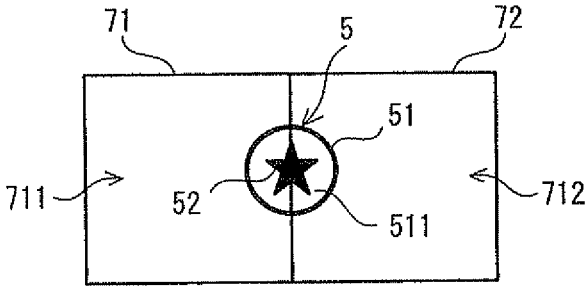
FIG. 9 is an explanatory figure of a pattern and a base area.

Assume, for example, that at Step S1, a pattern 5 that is shown in FIG. 8 is selected from the list of the built-in patterns and is specified as the object pattern. The pattern 5 is a pattern in which a star 52 is disposed inside a circle 51. In a case where the user has not specified the base area, an area 511 inside the contour line of the circle 51 of the pattern 5 is specified as the base area. In contrast, in a case where a square that encloses the pattern 5 has been input by the user, for example, the area inside the contour line of the square is specified as the base area. Note that in a case where the user wants to sew the base area with a plurality of different types of thread, the user can designate a plurality of the base areas. For example, in a case where, after the aforementioned pattern 5 has been designated as the object pattern, the user inputs contour lines of two contiguous squares 71 and 72 that divide the pattern 5 into two parts, as shown in FIG. 9, two areas 711 and 712 inside the contour lines of the squares 71 and 72 are each designated as the base areas.

Next, the contour lines of the base areas and the lines of the object pattern other than the contour lines of the base areas (hereinafter called the other lines) are set to be sewn with satin stitches or not sewn with satin stitches, and that information is stored in the RAM 12 (Step S3). In the aforementioned example that is shown in FIG. 8, the contour line of the circle 51 of the pattern 5 is the contour line of the base area, and the contour line of the star 52 is the other line. In the example that is shown in FIG. 9, the contour lines of the areas 711 and 712 are the contour lines of the two base areas, and the contour line of the circle 51 and the contour line of the star 52 of the pattern 5 are the other lines. The setting of the satin stitching for the lines may be performed according to a command from the user, and it may also be performed in accordance with a pre-registered setting.

Next, the types of the threads to be used for sewing the base stitches to be formed in the base areas are set (Step S4). In the present embodiment, the colors of the threads are set as the types of the threads. If the base area has been designated by the user, the color of the thread that is designated by the user is set. If the base area is an area inside the contour line of the built-in pattern, the color of the thread may be set according to the color of the area, as indicated by the embroidery data or the image data, and it may also be designated by the user. Note that in addition to the color of the thread, the thickness and the material of the thread may also be set as the type of the thread. In the case where the plurality of the contiguous base areas 711, 712 have been designated, as in the example that is shown in FIG. 9, different thread colors are set for each of the contiguous base areas 711, 712 at Step S4.

The types of stitches other than the base stitches in the base areas (hereinafter called the stitch types) are set, and that information is stored in the RAM 12 (Step S5). To be specific, the stitch types are set by the user for each of the areas and the patterns that are included in the object pattern. For the built-in pattern for which the embroidery data have been stored in the pattern data storage area 151 (refer to FIG. 1), the stitch types may be set in accordance with the embroidery data. The stitch types are selected from among three types of stitches that include satin stitches, tatami stitches, and see-through stitches, for example. The see-through stitches are stitches that have a lower thread density than the satin stitches and the tatami stitches. The thread density of the see-through stitches is a value such that the object of sewing can be seen through the stitches. A plurality of types of the thread density can be set as the thread density of the see-through stitches. The thread density of the see-through stitches is set according to a user designation or automatically according to a brightness value of the image that describes the pattern.

The thread density in the embroidery pattern usually indicates the number of threads that determines how many stitches are sewn side-by-side per unit length in the embroidery pattern. However, in the present embodiment, an example will be explained in which the thread density of the see-through stitches is set by the number of overlapping layers that have different stitching directions. Note that the thread density of the see-through stitches may also be set in the usual manner, by the number of stitches that are sewn per unit length in the embroidery pattern. A method for regulating the thread density of the see-through stitches will be described later.

Figure 11:
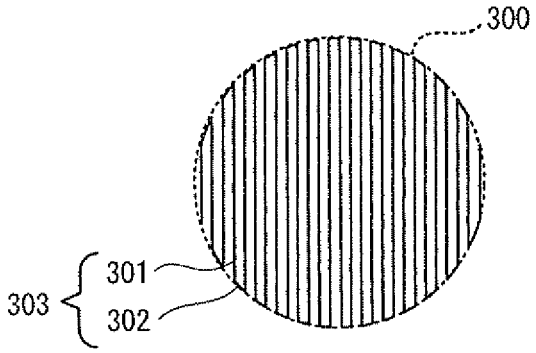
FIG. 11 is an explanatory figure of an arrangement of first stitches and second stitches in a stitch layer.

Next, base stitch processing is performed that creates the data for sewing the base stitches to be formed in the base areas (Step S6). The base stitch processing will be explained with reference to FIGS. 4 to 5 and FIGS. 8 to 16. Note that in the present embodiment, the base stitches that include the plurality of intersection points are formed by overlapping a plurality of stitch layers. Each of the plurality of stitch layers contains a plurality of first stitches for which the stitching direction is the same and a plurality of second stitches that link the plurality of first stitches. For example, in a case where an area inside a contour line 300 is the base area, as shown in FIG. 11, in each of the stitch layers, the plurality of first stitches are formed on a plurality of line segments 301 that all extend in the same direction. The plurality of second stitches are formed on a plurality of line segments 302 that link the line segments 301 along the contour line 300 of the base area. The first stitches and the second stitches of the stitch layer are formed by running stitches on a single line 303 in which all of the line segments 301 and the line segments 302 are connected, as shown in FIG. 11.

The base stitches in the present embodiment are formed by the overlapping of the plurality of stitch layers, in each of which the stitching direction of the first stitches that correspond to the line segments 301 is different. Accordingly, in the present embodiment, the stitching direction of the first stitches in each of the plurality of layers (hereinafter simply called the stitching direction) is set in advance in a stitching direction table that is stored in the settings storage area 152 of the HDD 15. In the present embodiment, as shown in FIG. 10, the stitching directions for a first layer to a fourth layer are respectively set to ninety degrees, zero degrees, forty-five degrees, and one-hundred-thirty-five degrees. Note that angles for a fifth and subsequent layers may also be set, of course, although this is not shown in the drawings. The stitching directions are expressed as angles of counterclockwise rotation in relation to the X axis of the XY coordinate system of the embroidery sewing machine 3 (refer to FIG. 2). The stitching directions are expressed as angles ranging from zero degrees to less than one-hundred-eighty degrees. As explained previously, the XY coordinate system is the coordinate system that is used in the processing by which the embroidery sewing machine 3 moves the embroidery frame 41.

Figure 4:
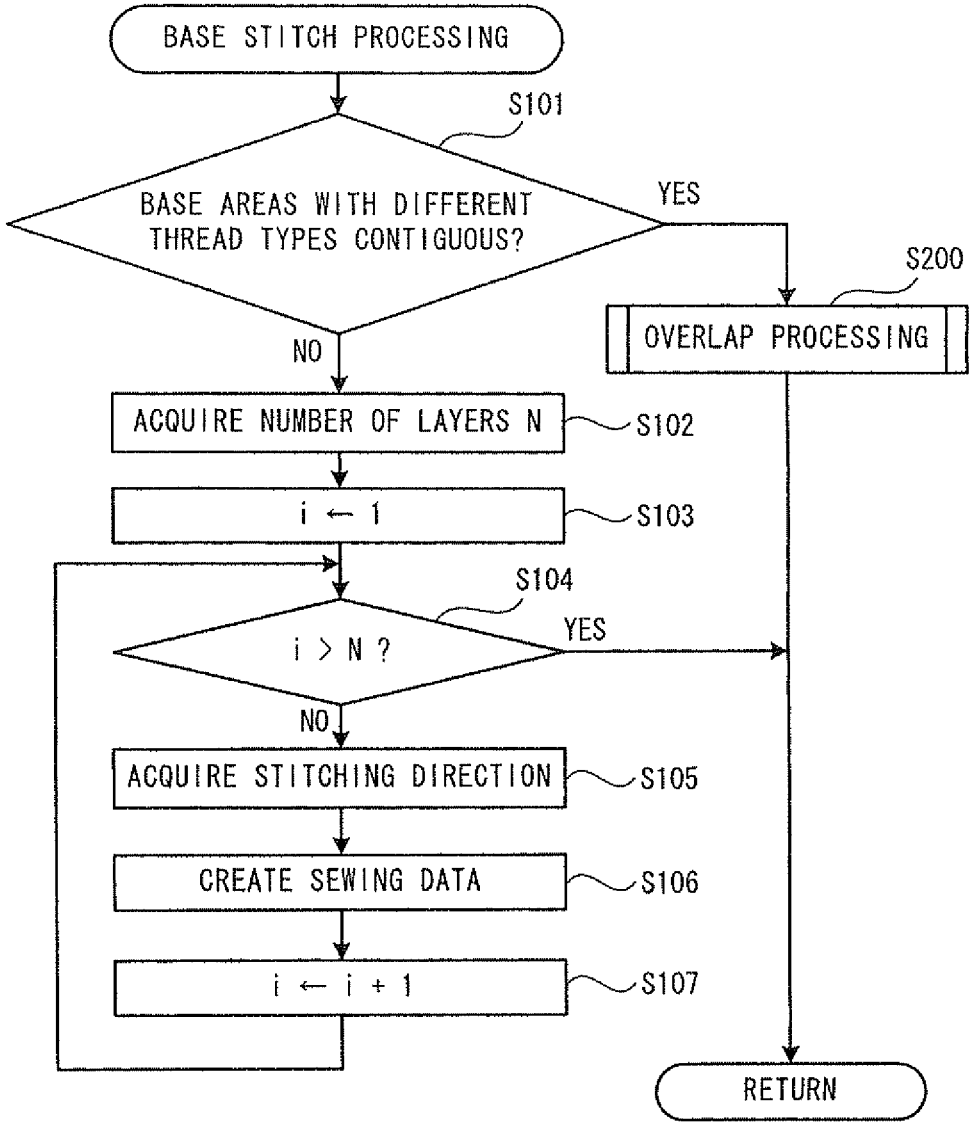
FIG. 4 is a flowchart of base stitch processing that is performed by the main processing.

As shown in FIG. 4, in the base stitch processing, first, it is determined whether base areas with different thread types are contiguous, based on the data that describe the base areas and that were stored in the RAM 12 at Step S2 and on the information that describes the thread types (in the present embodiment, the thread colors) that were set at Step S4 (Step S101). In the case of the two contiguous base areas 711, 712, for which different thread colors were set, as shown in the example in FIG. 9 (YES at Step S101), overlap processing is performed (Step S200). The overlap processing will be described later.

In the case of the base area 511, which is not contiguous with another base area for which a different thread color has been set, as shown in the example in FIG. 8 (NO at Step S101), a number of the stitching layers N that are to be overlapped for forming the base stitches (hereinafter called the number of the layers) is acquired and is stored in the RAM 12 (Step S102). The number of the layers N is one of a value that is designated by the user, a value that is set in advance, and a value that is set based on the brightness value of the object pattern. Hereinafter, an example will be explained in which a value of 4 that has been set by the user is acquired, and four stitch layers are formed.

A variable i for specifying the stitch layer that is the object of the processing is set to 1, and the set value of 1 is stored in the RAM 12 (Step S103). it is determined whether the variable i is greater than the number of the layers N (Step S104). That is, in the processing at Step S104, it is determined whether the processing of N stitch layers has been completed. In a case where the variable i is not greater than N (NO at Step S104), the stitching direction table (refer to FIG. 10) is referenced, and the stitching direction is acquired for the i-th layer that is the object of the processing. The acquired stitching direction (angle) is stored in the RAM 12 (Step S105). In the first round of the processing, ninety degrees is acquired as the stitching direction for the first layer.

Sewing data are created for sewing the stitches of the i-th layer in the base area, and the created sewing data are stored in the RAM 12 (Step S106). For example, in a case where the contour line of the circle 51 of the pattern 5 in FIG. 8 corresponds to the contour line 300 in FIG. 11, for the first layer, in which the stitching direction is ninety degrees, the sewing data for forming the running stitches on the line 303, that is, the data that indicate the positions of the needle drop points and the sewing order, are created. The variable i that is stored in the RAM 12 is then incremented (Step S107). Then the processing returns to Step S104, and the processing that is described above (NO at Step S104; Steps S105 to S107) is repeated until the variable i is greater than the number of the layers N. Note that in a case where the variable i is not less than 2, that is, in the processing for the second and subsequent layers, at Step S106, in addition to the sewing data for forming the running stitches on the line 303, sewing data are created for the running stitches that will be formed on the contour line of the base area for linking the last needle drop point of the (i−1)th layer and the first needle drop point of the i-th layer.

Figure 12:
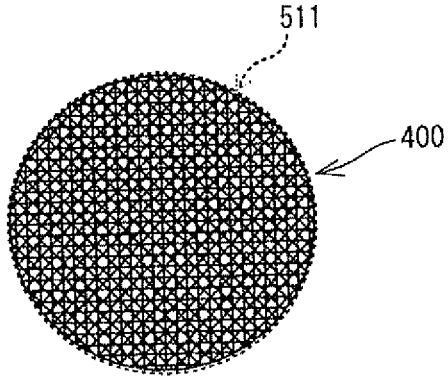
FIG. 12 is an explanatory figure of completed base stitches.

In a case where the variable i becomes greater than the number of the layers N (YES at Step S104), the sewing data for the N stitch layers have been created, and the sewing data for the base area are complete. Accordingly, the CPU 11 terminates the base stitch processing that is shown in FIG. 4 and returns to the main processing that is shown in FIG. 3. The base stitch processing that is described above creates the sewing data for forming, in the base area 511 inside the circle 51 of the pattern 5 that is shown in FIG. 8, base stitches 400 that is made up of running stitches in a mesh form, as shown in FIG. 12. The base stitches 400 is produced by the overlapping of the stitches in the first to the fourth layers. The base stitches that is formed in this manner includes the plurality of the intersection points where the first stitches of the various stitch layers intersect, and the thread density is nearly uniform throughout the entire base area.

The overlap processing that is performed in a case where a plurality of base areas to be sewn with different types of threads are contiguous will be explained with reference to FIGS. 5, 9, 10, and 13 to 16. For example, in a case where two contiguous areas are sewn with red and blue threads respectively, first one of the areas is sewn with the red thread, and then the other area is sewn with the blue thread. In a case where the overlapping base stitches form the stitch layers that are described above in each of the areas and the object of sewing is removed, the red base stitches and the blue base stitches themselves remain without being undone, but they may separate from one another at the boundary line. Accordingly, in the overlap processing, an overlapping portion is formed between the contiguous base areas in order to prevent the base stitches from separating. The overlapping portion is a region in which a portion of the base stitches that are formed in one of the two contiguous base areas intersect or overlap with a portion of the base stitches that are formed in the other base area. Note that hereinafter, this will be explained using an example in which the thread colors for the base areas 711, 712 that is shown in FIG. 9 are set to different colors (for example, red and blue).

First, the number of the layers N is acquired (Step S201), in the same manner as at Step S102 of the base stitch processing (refer to FIG. 4). Assume that 4 has been set as the number of the layers N. Next, a point on the boundary line between the contiguous base areas is specified as desired (Step S202). Note that it is preferable for the point that is specified here to be a characteristic point that indicates a characteristic of the boundary line. For example, in a case where the boundary line is a curve, the specified point may be a point where the curvature changes or the like. If the boundary line is a straight line, as in the example in FIG. 9, the point may be specified at any position on the line. A tangent line that is tangent to the boundary line at the specified point is specified (Step S203). In the example in FIG. 9, a straight line that is located on the boundary line between the base areas 711, 712 is specified as the tangent line.

The stitching direction for the first layer is set based on the direction in which the specified tangent line extends (hereinafter called the tangent line direction) (Step S204). Specifically, the tangent line direction (angle) is specified in the XY coordinate system of the embroidery sewing machine 3 (refer to FIG. 2). The specified tangent line direction is compared to the stitching direction for the first layer (ninety degrees) that has been set in the stitching direction table that is shown in FIG. 10. In a case where the angles of the tangent line direction and the stitching direction are different, that is, where they intersect, the ninety degrees that is set in the stitching direction table is stored as is in the RAM 12 as the stitching direction for the first layer. On the other hand, in a case where the tangent line direction (ninety degrees) and the stitching direction (ninety degrees) are the same, as in the example that is shown in FIG. 9, ninety degrees is subtracted from the ninety degrees that is set in the stitching direction table, and the resulting zero degrees is stored in the RAM 12 as the stitching direction for the first layer. This is done in order to form a stitch layer in the first layer in which the stitching direction intersects the tangent line, because a stitch layer in which the first stitches are formed in a direction that intersects the tangent line makes the overlapping portion, which will be described later, more effective at preventing the separation of the base areas than does a stitch layer in which the first stitches are formed in the same direction as the tangent line.

The variable i for specifying the stitch layer that is the object of the processing and a variable j for specifying the base area that is the object of the processing are both set to 1. The set values are stored in the RAM 12 (Step S205). If the variable i is not greater than the number of the layers N (NO at Step S206), it is determined whether the variable j is greater than a number M of the base areas (Step S207). In other words, in the processing at Step S207, it is determined whether the processing of M base areas has been completed. If the variable j is not greater than the number of the base areas M (NO at Step S207), the j-th base area that is the object of the processing is enlarged by a specified amount from the boundary line in the direction of the contiguous base area (Step S208). In the example in FIG. 9, in the first round of the processing, the first base area 711 is enlarged across the boundary line in the direction of the base area 712. Data that describe the base area after the enlargement are stored in the RAM 12.

Note that the amount of the enlargement of the base area may be sufficient if it ensures that the separation of the base stitches can be prevented by one of the intersecting and the overlapping of a portion of the base stitches that are formed in one of the base areas with a portion of the base stitches that are formed in the other base area, within the overlapping portion to be formed. Accordingly, the amount of the enlargement may be set in accordance with the thread density or the like of the base stitches, and it may also be defined uniformly as a specified distance from the boundary line.

After the area is enlarged, the stitching direction for the i-th layer is set (Step S209). The stitching direction for the first layer is the stitching direction that was set at Step S204. The stitching directions for the second and subsequent layers are set by referencing the stitching direction for the first layer and the stitching direction table (refer to FIG. 10). Specifically, in a case where the stitching direction for the first layer is different from the direction that is set in the stitching direction table, the stitching direction (angle) for the i-th layer is set to an angle that is computed by subtracting ninety degrees from the stitching direction (angle) that is set in the stitching direction table. Note that in a case where the subtracting of ninety degrees results in an angle that is not greater than zero degrees, an angle may be used that is computed by adding ninety degrees to the direction (angle) that is set in the stitching direction table. In a case where the stitching direction for the first layer is the same as the direction that is set in the stitching direction table, the stitching direction (angle) for the i-th layer is defined as the direction (angle) that is set in the stitching direction table.

In accordance with the stitching direction that has been set, the sewing data for sewing the stitches of the i-th layer in the enlarged j-th base area are created and stored in the RAM 12 (Step S210). The method for creating the sewing data is the same as the processing at Step S106 in FIG. 4. The variable j that is stored in the RAM 12 is incremented (Step S211). Then the processing returns to Step S207, and the processing that is described above is repeated until the variable j becomes greater than the number of the base areas M (NO at Step S207; Steps S208 to S211). In the example in FIG. 9, the second base area 712 is also enlarged, and after the sewing data are created for the enlarged base area, the variable j becomes 3, which is greater than 2, the number of the base areas (YES at Step S207). Therefore, the variable i is incremented, and the variable j is once again set to 1 (Step S212). Then the processing returns to Step S206, and the processing is performed as described above for the next layer (Steps S207 to S212). In the processing for the second and subsequent layers, sewing data are also created for the running stitches to be formed on the contour line of each of the base areas for linking the last needle drop point of the (i−1)th layer and the first needle drop point of the i-th layer in each of the base areas.

Figure 5:
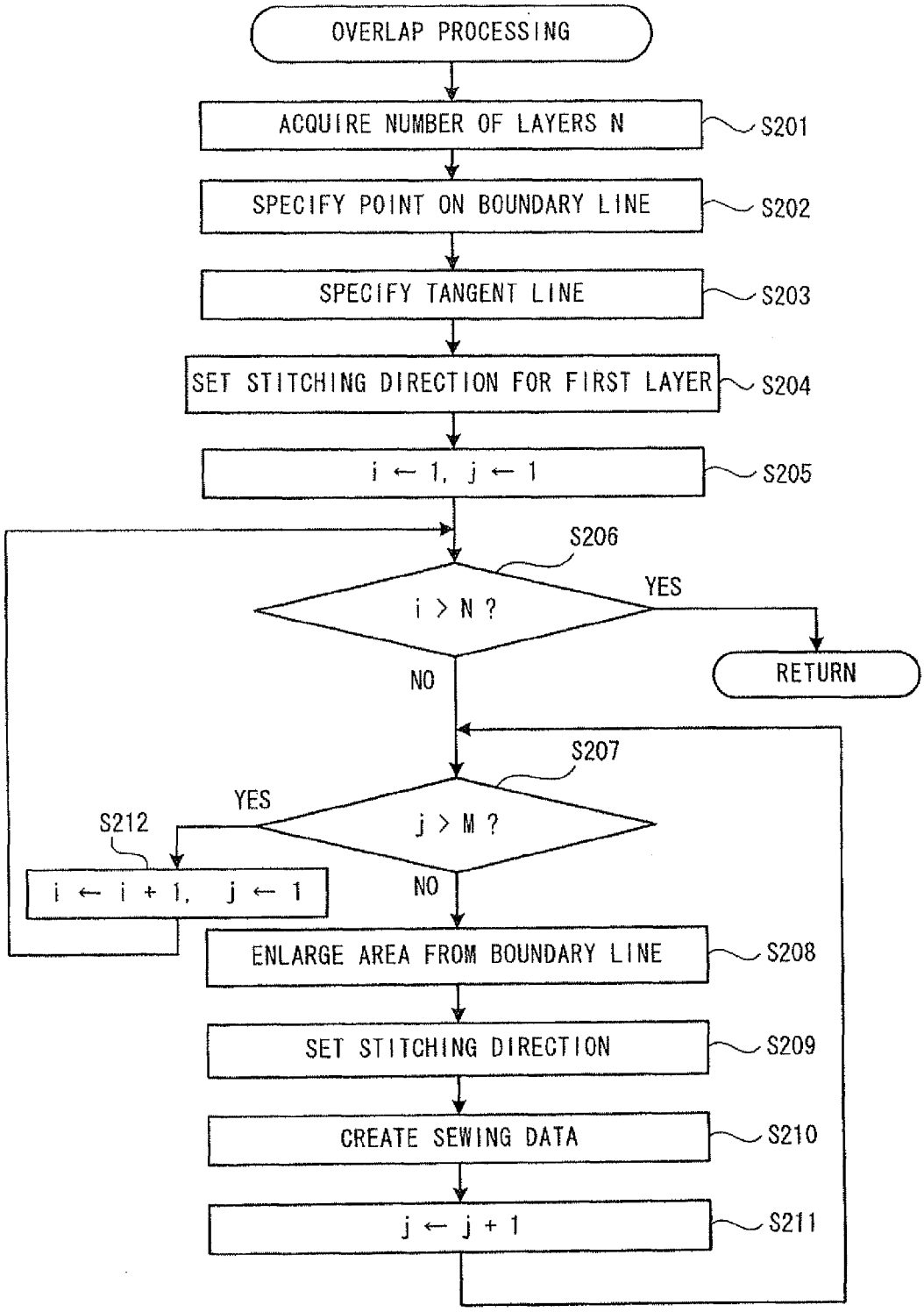
FIG. 5 is a flowchart of overlap processing, according to a first embodiment, that is performed in the base stitch processing.

The processing is repeated, and after the processing has been performed for the base areas 711, 712 of the fourth layer, the variable i becomes 5, which is greater than the number of the layers 4 (YES at Step S206), so the creating of the sewing data for the base stitches is terminated. Accordingly, the CPU 11 terminates the overlap processing that is shown in FIG. 5 and returns to the base stitch processing that is shown in FIG. 4. The CPU 11 then terminates the base stitch processing and returns to the main processing that is shown in FIG. 3.

The stitches that are described by the sewing data for the first to the fourth layers that are created for the example in FIG. 9 by the overlap processing that has been explained above are shown FIGS. 13 to 16, respectively. Note that the reference numerals 711, 712 in FIGS. 13 to 16 indicate the pre-enlargement base areas 711, 712, and the stitches in the base area 712 are indicated by broken lines in order to distinguish them from the stitches in the base area 711. Note also that the positions of needle drop points are shown only in FIG. 13.

Figure 13:
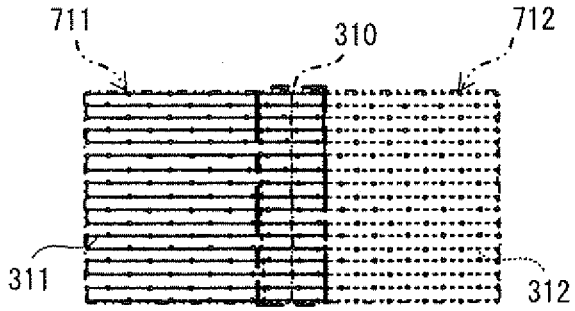
FIG. 13 is an explanatory figure of stitches in a first layer.

In the first layer, as shown in FIG. 13, the base area 711 is enlarged in the direction of the base area 712, and the sewing data are created for forming a stitch series 311 that includes a plurality of the first stitches that extend in the zero-degree direction and a plurality of the second stitches that link the first stitches. Then the base area 712 is enlarged in the direction of the base area 711, and the sewing data are created for forming a stitch series 312 that includes a plurality of the first stitches that extend in the zero-degree direction and a plurality of the second stitches that link the first stitches. An overlapping portion in which a portion of the stitch series 311 intersects or overlaps with a portion of the stitch series 312 is formed in a region 310 by the enlarging of the base areas 711, 712.

Figure 14:
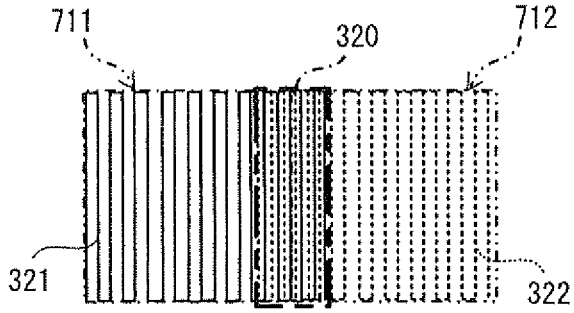
FIG. 14 is an explanatory figure of stitches in a second layer.
Figure 15:
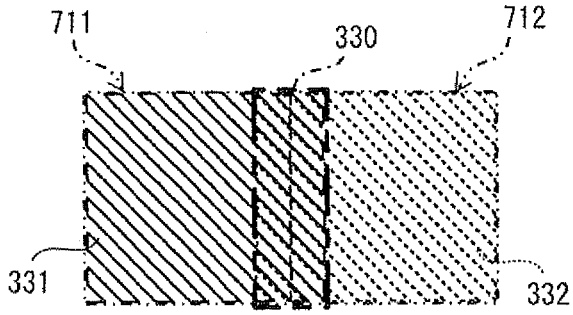
FIG. 15 is an explanatory figure of stitches in a third layer.
Figure 16:
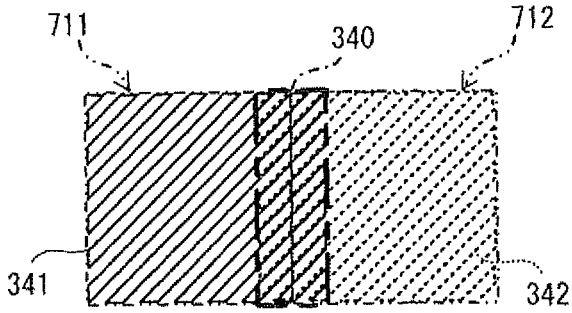
FIG. 16 is an explanatory figure of stitches in a fourth layer.

In the second layer, as shown in FIG. 14, the base areas 711, 712 are both enlarged, and the sewing data are created for forming stitch series 321, 322, in which the stitching direction for the first stitches is ninety degrees. An overlapping portion in which a portion of the stitch series 321 intersects or overlaps with a portion of the stitch series 322 is formed in a region 320 by the enlarging of the base areas 711, 712. In the same manner, in the third layer, as shown in FIG. 15, the sewing data are created for forming stitch series 331, 332, in which the stitching direction for the first stitches is one-hundred-thirty-five degrees. An overlapping portion in which a portion of the stitch series 331 intersects or overlaps with a portion of the stitch series 332 is formed in a region 330 by the enlarging of the base areas 711, 712. In the same manner, in the fourth layer, as shown in FIG. 16, the sewing data are created for forming stitch series 341, 342, in which the stitching direction for the first stitches is forty-five degrees. An overlapping portion in which a portion of the stitch series 341 intersects or overlaps with a portion of the stitch series 342 is formed in a region 340 by the enlarging of the base areas 711, 712.

In this manner, in the overlap processing in the present embodiment, the overlapping portion is formed in each of the stitch layers in a region that covers the boundary line between the contiguous base areas. Therefore, the portions where the base stitches of the contiguous base areas intersect and overlap in the overlapping portion are increased further by the superposing of the plurality of the stitch layers.

As shown in FIG. 3, after the base stitch processing (Step S6), pattern stitch processing is performed (Step S7). In the pattern stitch processing, the sewing data are created for sewing the lines and areas that are contained in the object pattern, in accordance with the information that was set at Steps S3 and S5. In the explanation that follows, in the example that is shown in FIG. 8, the area 511 inside the circle 51 of the pattern 5 is defined as the base area, with satin stitches being set for its contour line, and satin stitches are also set for the area inside the star 52. In the example that is shown in FIG. 9, satin stitches are not set for the contour lines of the base areas 711, 712, satin stitches are set for the area inside the contour line of the star 52 of the pattern 5, see-through stitches are set for the area outside the star 52 within the circle 51, and satin stitches are set for the contour line of the circle 51.

The pattern stitch processing will be explained in detail with reference to FIGS. 6 and 7. First, it is determined whether an area exists for which see-through stitches have been set (Step S300). For example, in the case of the previously described example in FIG. 8, there is no area for which see-through stitches have been set (NO at Step S300), so the processing advances to Step S309, which will be described later. On the other hand, in the example in FIG. 9, see-through stitches have been set for the area outside the star 52 within the circle 51 (YES at Step S300), so based on one of a command from the user and a set value, it is determined whether the thread density of the see-through stitches will be set automatically (Step S301).

In a case where the thread density of the see-through stitches has been designated by the user (NO at Step S301), a variable L is set to 1 and is stored in the RAM 12 (Step S304). L is a variable for reading, in order, an L-th area for which the see-through stitches are set as the stitch type. Next, the thread density for the L-th area is acquired and stored in the RAM 12 (Step S305). In the present embodiment, the thread density of the see-through stitches is regulated by the number of the stitch layers, in the same manner as for the base stitches that are described above. The user can designate a value from zero to 7, for example, as the number of the stitch layers. The sewing data for forming the see-through stitches in the L-th area at the designated density (number of layers) are created and stored in the RAM 12 (Step S306). The processing at Step S306 may be the same as at Steps S103 to S107 in the base stitch processing in FIG. 4, for example. However, the stitching direction for the i-th layer of the see-through stitches is not acquired from the stitching direction table (refer to FIG. 10), but is defined as an angle (180/i degrees) that is derived by dividing 180 degrees by the variable i.

It is determined whether the processing that creates the sewing data has been completed for all of the areas for which the see-through stitches have been set as the stitch type (Step S307). Specifically, if the variable L is less than the number of the areas for which the see-through stitches have been set as the stitch type, a determination is made that an area exists for which the sewing data have not been created (NO at Step S307). The variable L is incremented (Step S308), and the processing returns to Step S305. In a case where the processing has been completed for all of the areas (YES at Step S307), the processing advances to Step S309.

In a case where the thread density of the see-through stitches will be set automatically (YES at Step S301), a color image that describes the object pattern is converted into a gray-scale image, and the gray-scale image is stored in the RAM 12 (Step S302). The method for converting the color image into the gray-scale image is widely known, so an explanation will be omitted. Next, automatic creation processing is performed (Step S303). In the automatic creation processing, the sewing data are created for the see-through stitches in accordance with the automatically set thread density, based on the brightness values (gray levels) in the gray-scale image.

The automatic creation processing will be explained in detail with reference to FIG. 7. In order for the areas for which the see-through stitches have been set as the stitch type to be processed sequentially, the variable L is set to 1 and is stored in the RAM 12 (Step S330). It is determined whether the processing that creates the sewing data has been completed for all of the areas for which the see-through stitches have been set as the stitch type (Step S331). In a case where the variable L is less than the number of the areas for which the see-through stitches have been set as the stitch type, and an area exists for which the sewing data have not been created (NO at Step S331), a brightness value YL is acquired for the L-th area and is stored in the RAM 12 (Step S332).

The acquired brightness value YL is compared to threshold values T1 to T4. The threshold values T1 to T4 are values that become progressively smaller in the order T1, T2, T3, T4 (T1>T2>T3>T4). The threshold values T1 to T4 are set in consideration of the method for regulating the thread density and of the brightness of the object pattern. In a case where the brightness value YL is not less than the threshold value T1 (YES at Step S333), a number of layers K for the stitch layers is set to zero (Step S334). In a case where the brightness value YL is less than the threshold value T1 and is not less than the threshold value T2 (NO at Step S333; YES at Step S335), the number of the layers K is set to 1 (Step S336). In a case where the brightness value YL is less than the threshold value T2 and is not less than the threshold value T3 (NO at Step S335; YES at Step S337), the number of the layers K is set to 3 (Step S338). In a case where the brightness value YL is less than the threshold value T3 and is not less than the threshold value T4 (NO at Step S337; YES at Step S339), the number of the layers K is set to 5 (Step S340). In a case where the brightness value YL is less than the threshold value T4 (NO at Step S339), the number of the layers K is set to 7 (Step S342).

The sewing data for forming the stitches in the L-th area in accordance with the number of the layers K that has been set as described above are created and stored in the RAM 12 (Step S343). The processing at Step S343 is the same as the previously described processing at Step S306 in FIG. 6. After the processing at one of Step S334 and Step S343, the variable L is incremented (Step S344), and the processing returns to Step S331. In a case where the processing has been completed for all of the areas for which the see-through stitches have been set as the stitch type (YES at Step S331), the automatic creation processing is terminated, and the CPU 11 returns to the pattern stitch processing in FIG. 6.

Figure 6:
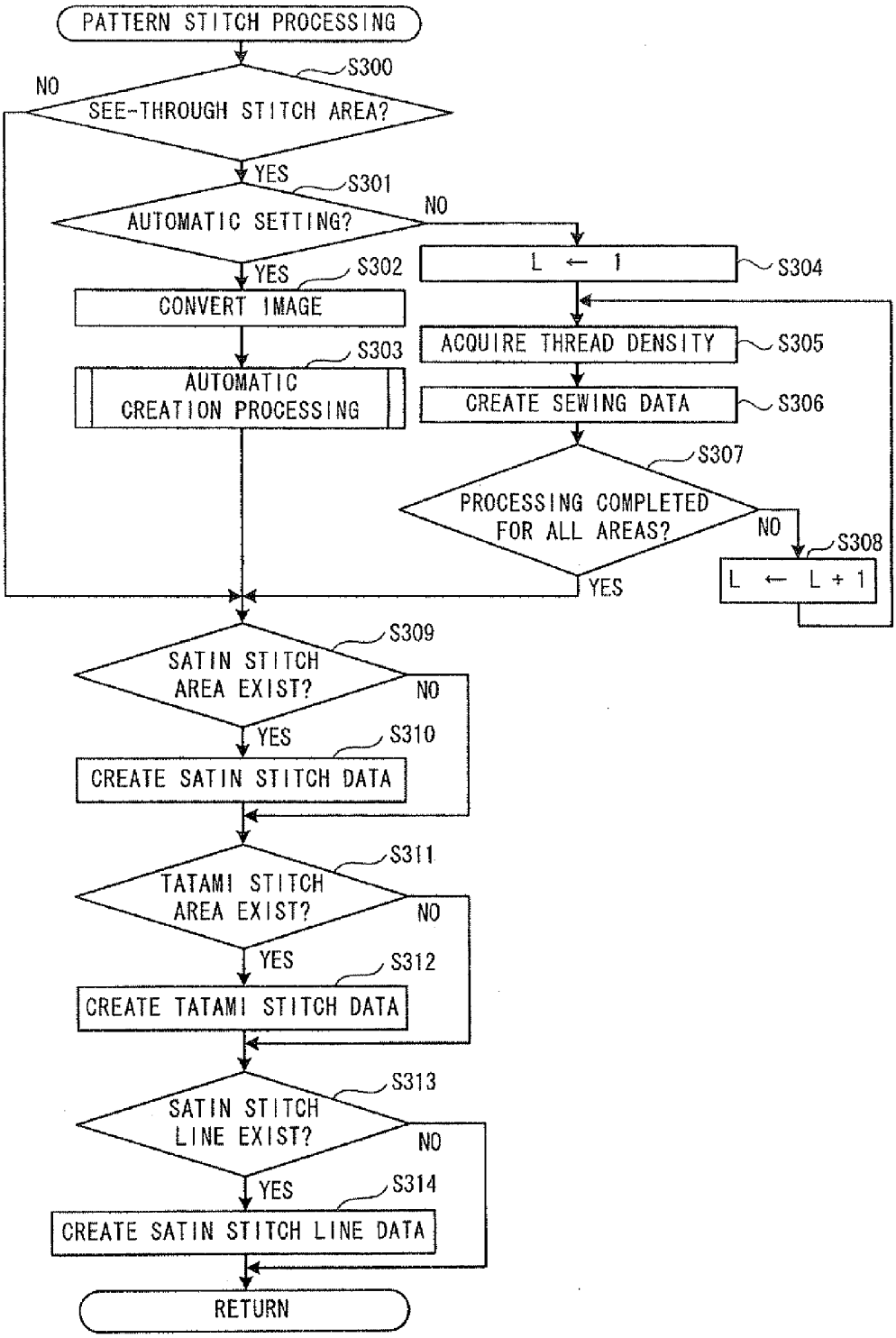
FIG. 6 is a flowchart of pattern stitch processing that is performed by the main processing.
Figure 7:
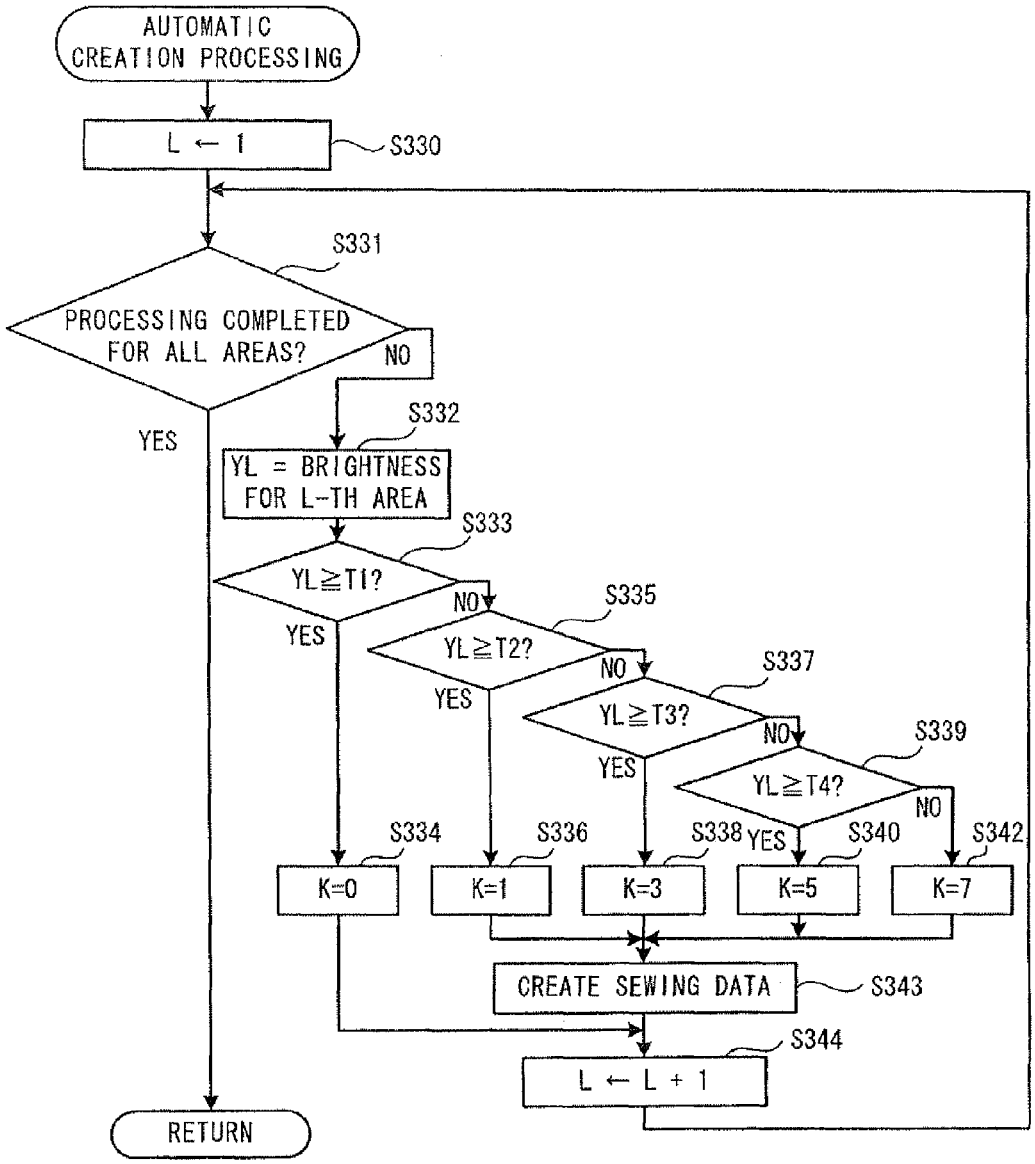
FIG. 7 is a flowchart of automatic creation processing that is performed in the pattern stitch processing.

As shown in FIG. 6, after the automatic creation processing (Step S303), it is determined whether an area exists for which the satin stitches have been set as the stitch type (Step S309). In a case where the satin stitches have been set for the area inside the star 52, as in the examples that are shown in FIGS. 8 and 9 (YES at Step S309), the sewing data for forming the satin stitches within that area are created and stored in the RAM 12 (Step S310). The method for creating the sewing data for the satin stitches is widely known, so an explanation will be omitted. The processing advances to Step S311. In a case where no area exists for which the satin stitches have been set as the stitch type (NO at Step S309), the processing advances directly to Step S311.

At step S311, it is determined whether an area exists for which the tatami stitches have been set as the stitch type. If an area exists for which the tatami stitches have been set (YES at Step S311), the sewing data for forming the tatami stitches within that area are created and stored in the RAM 12 (Step S312). The method for creating the sewing data for the tatami stitches is widely known, so an explanation will be omitted. The processing advances to Step S313, which will be described later. In a case where no area exists for which the tatami stitches have been set as the stitch type (NO at Step S311), the processing advances directly to Step S313.

At step S313, it is determined whether a line exists that has been set to be sewn by the satin stitches. In the previously described examples in FIGS. 8 and 9, the contour line of the circle 51 has been set to be sewn by the satin stitches (YES at Step S313). In this case, the sewing data for forming the satin stitches on the line are created and stored in the RAM 12 (Step S314). The CPU 11 terminates the pattern stitch processing and returns to the main processing in FIG. 3. In a case where no line exists that has been set to be sewn by the satin stitches (NO at Step S313), the CPU 11 immediately terminates the pattern stitch processing and returns to the main processing in FIG. 3.

As shown in FIG. 3, following the pattern stitch processing (Step S7), the embroidery data are created and stored in the embroidery data storage area 153 (refer to FIG. 1) (Step S8). Specifically, the embroidery data are created such that, after the base stitches are sewn based on the base stitches sewing data that were created by the base stitch processing (Step S6), the other lines and areas are sewn based on the sewing data that were created by the pattern stitch processing (Step S7). Note that in a case where the overlap processing (refer to FIG. 5) has been performed for a plurality of the base areas, the sewing data will be created such that, after the base stitches have been formed in one of the base areas by sewing the stitches for N layers with the thread that was set at Step S4 in the main processing (refer to FIG. 3), the base stitches will be formed in the other base area in the same manner. After the embroidery data have been created, the main processing is terminated.

Figure 17:
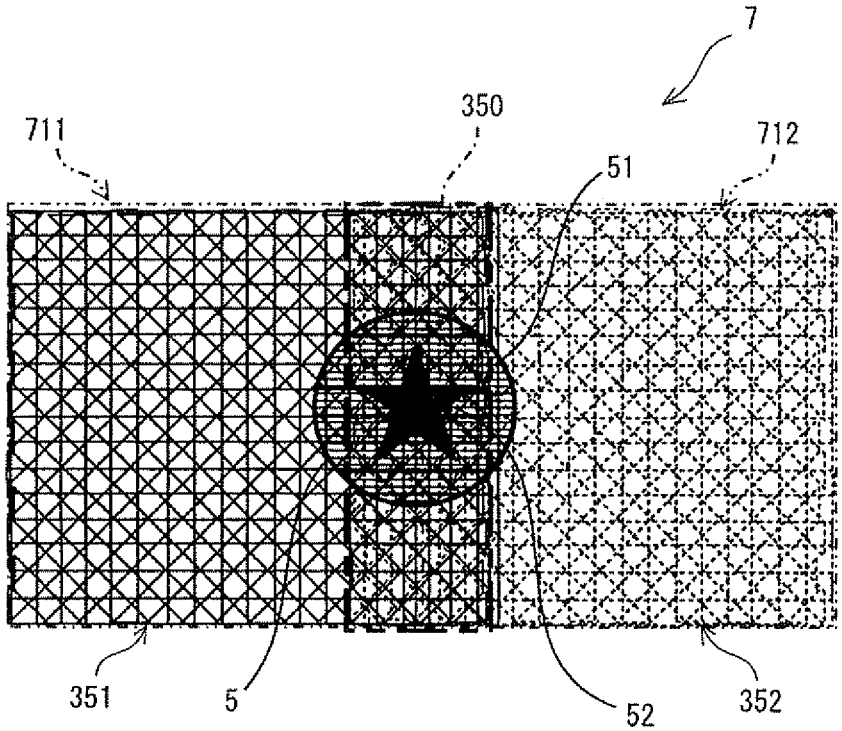
FIG. 17 is an explanatory figure of a completed pattern.

In a case where the embroidery sewing is performed based on the embroidery data that have been created for the previously described example in FIG. 9, a pattern 7 like that shown in FIG. 17 is produced. As shown in FIG. 17, the base areas 711, 712 are each enlarged, and base stitch series 351, 352 are formed in mesh form within the enlarged base areas. The base stitch series 351, 352 are each constructed from four stitch layers. Then, on top of the base stitch series 351, 352, the pattern 5 is formed, which includes the circle 51 that is sewn with the see-through stitches and the star 52 that is sewn with the satin stitches. An overlapping portion 350 is formed in the region where the base areas 711, 712 overlap after they are enlarged.

The overlapping portion 350 is equivalent to a portion that is formed by superposing the overlapping portion regions 310, 320, 330, 340 that are shown in FIGS. 13 to 16. Therefore, the portions where the base stitch series 351, 352 intersect and overlap in the overlapping portion 350 are increased further. Thus, the providing of the overlapping portion 350 makes it possible to prevent the base stitch series 351, 352 from separating, even in a case where the object of sewing (for example, a water-soluble sheet) is removed after the pattern 7 has been embroidered on the object of sewing. Furthermore, as described previously, the base stitch series 351, 352 themselves contain pluralities of intersecting portions, so they can maintain their shapes, without coming undone, even if the object of sewing is removed. Therefore, the shape of the entire pattern 7 can be maintained, even if the object of sewing is removed.

As explained above, according to the embroidery data creation apparatus 1 in the present embodiment, at least one of the base areas is specified, and the sewing data for forming the base stitches in the base area are created. The base stitches are the stitches that include a plurality of the intersection points where two of the stitches that extend in different directions intersect. In a case where the specified base areas include two contiguous areas to be sewn with threads of different types, each of the base areas is enlarged in the direction that extends across the boundary line with the other base area, and then the sewing data for forming the base stitches are created. Thus the sewing data is created that form, in the region where the enlarged base areas overlap, the overlapping portion that is the region in which a portion of the base stitches that are formed in one of the base areas intersect or overlap with a portion of the base stitches that are formed in the other base area. Even if the object of sewing is removed, after the base stitches are formed according to the sewing data, the stitches of the entire area will be maintained, because the overlapping portion prevents the base stitches in the two base areas from separating between the two base areas. Therefore, according to the embroidery data creation apparatus 1 in the present embodiment, sewing data can be produced that are suited to the embroidered object.

Furthermore, in the present embodiment, the base stitches are formed by the overlapping of the plurality of stitch layers in which the stitching directions are different. Within any one of the stitch layers, the plurality of first stitches are formed in the same stitching direction. The stitching direction within any one of the stitch layers is also the same in the two contiguous base areas. Therefore, the sewing data can be produced that can result in beautiful base stitches, with the stitching directions aligned, when the two contiguous base areas are viewed as a whole. Moreover, because the stitching direction of the plurality of first stitches is the same within any one stitch layer, the thread density of the base stitches can easily be made uniform within a given base area.

Also, in the present embodiment, the stitching direction of the first layer of the plurality of stitch layers is set such that it intersects a line that is tangent to the boundary line between the two contiguous base areas at a specified point on the boundary line. If the stitching directions in all of the plurality of stitch layers within any one base area are parallel to the tangent line of the boundary line, the effect of the overlapping portion in preventing the separating of the two base areas may be weakened. Therefore, setting the stitching direction for the first layer in this way to a direction that intersects the boundary line makes it possible for the overlapping portion to reliably prevent the separating of the two areas.

Figure 18:
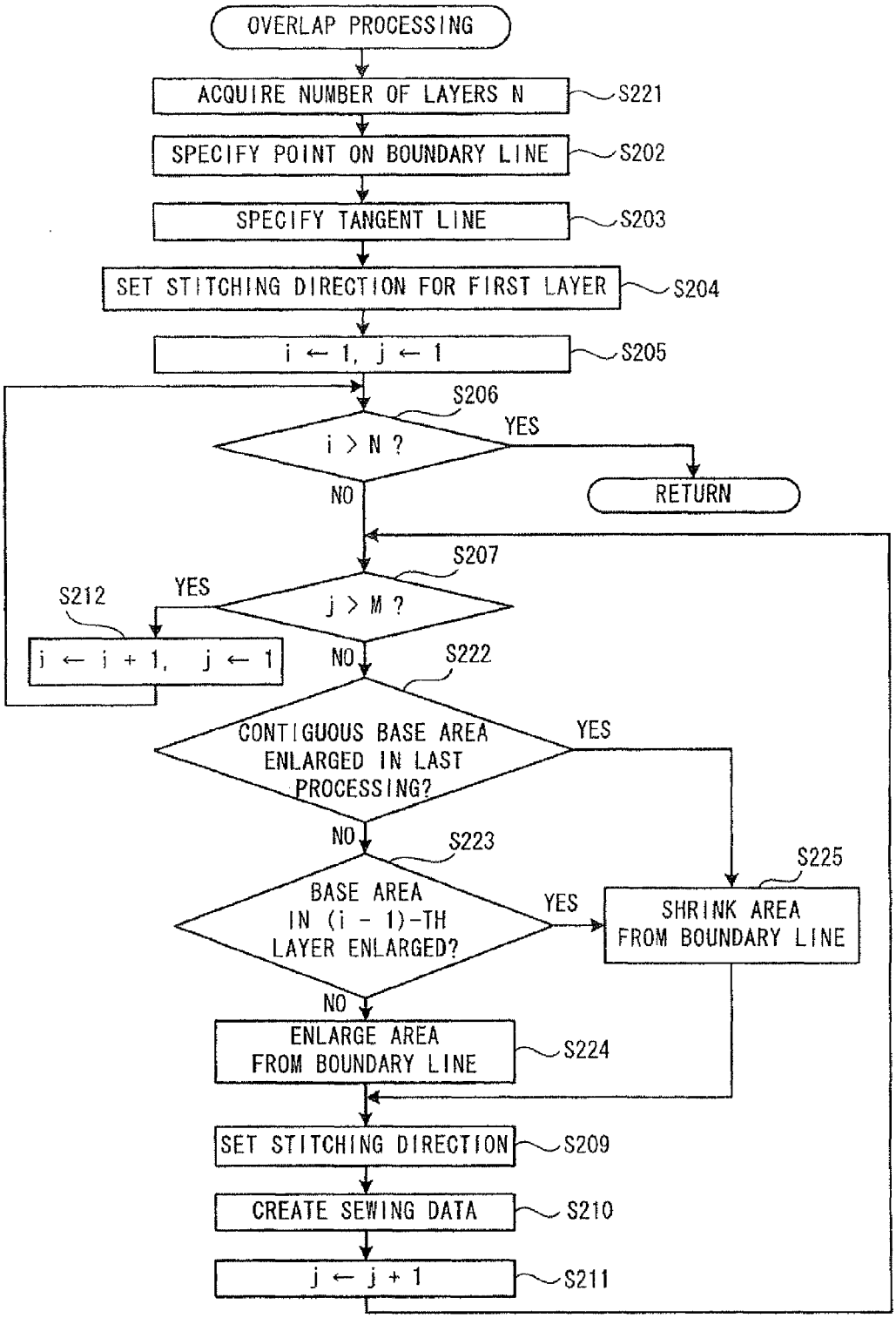
FIG. 18 is a flowchart of overlap processing according to a second embodiment.
Figure 19:
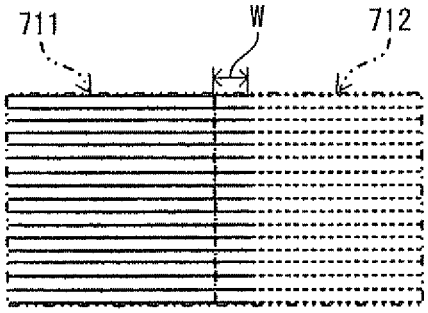
FIG. 19 is an explanatory figure of stitches in a first layer.
Figure 20:
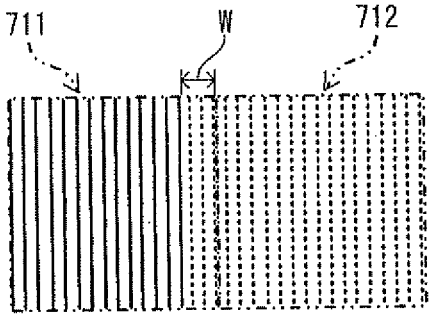
FIG. 20 is an explanatory figure of stitches in a second layer.
Figure 21:
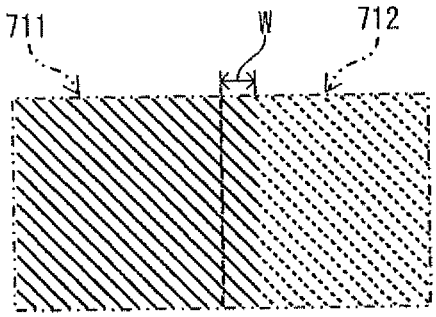
FIG. 21 is an explanatory figure of stitches in a third layer.
Figure 22:
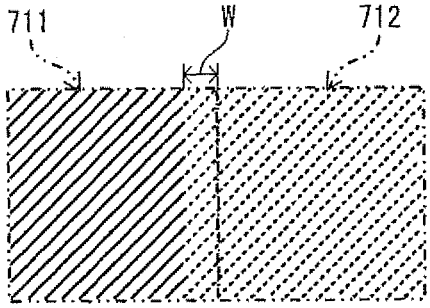
FIG. 22 is an explanatory figure of stitches in a fourth layer.

Hereinafter, a second embodiment of the present disclosure will be explained with reference to FIGS. 18 to 23. In the second embodiment, overlap processing that is shown in FIG. 18 is performed instead of the overlap processing in the first embodiment that is shown in FIG. 5. The processing other than the overlap processing is identical to that in the first embodiment in both structure and processing. In the overlap processing in the first embodiment, both of the two contiguous base areas are enlarged. Therefore, the thickness of the overlapping portion that is formed is greater than that of the other portions of the base areas. In contrast, in the overlap processing in the second embodiment, the sewing data are created such that the overlapping portion includes the same number of stitch layers as those of the two contiguous base areas. Therefore, the sewing data are created such that the thicknesses of the overlapping portion and the other portions of the base areas are uniform. Note that in FIG. 18, the same step numbers are assigned to steps where processing is identical to the overlap processing in the first embodiment that is shown in FIG. 5. Hereinafter, for the overlap processing in the second embodiment, only the processing that is different from that in the first embodiment will be explained, using as an example the processing of the base areas 711, 712 that are shown in FIG. 9.

Even in the second embodiment, the base stitches that are formed in the base areas are formed from the plurality of stitch layers, in the same manner as in the first embodiment. Accordingly, first, the number N of the stitch layers is acquired, as shown in FIG. 18 (Step S221). However, in the second embodiment, the number of the layers N is an even number, in order to make the thicknesses of the overlapping portion and the other portions of the base areas uniform. Therefore, at Step S221, one of an even number that has been set in advance and an even number that is designated by the user is acquired as the number of the layers N. Hereinafter, the explanation will assume that 4 is acquired as the number of the layers.

Next, the processing at Steps S202 to S207 is performed, which is the same as in the first embodiment. Then it is determined whether, for the j-th base area in the i-th layer, which is the object of the processing, a contiguous base area was enlarged, in the last processing, in the direction of the base area that is the current object of the processing (Step S222). In the first round of the processing, the first base area 711 of the first layer is the object of the processing. In this case, there is no area that was enlarged in the last processing (NO at Step S222). Next, it is determined whether, for the j-th base area in the i-th layer, which is the object of the processing, the j-th base area in the (i−1)th layer was enlarged (Step S223). In the first round of the processing, the first base area 711 of the first layer is the object of the processing. In this case, the (i−1)th layer (the 0-th layer) does not exist. Therefore, the first base area of the (i−1)th layer has not been enlarged (NO at Step S223). In this case, the base area 711 is enlarged across the boundary line in the direction of the base area 712 (Step S224). Then the sewing data for forming the stitches in the enlarged base area 711 are created by the processing at Steps S209, S210, which is the same as in the first embodiment. Thereafter, in a case where the second base area 712 is defined as the object of the processing (Step S211; NO at Step S207), the contiguous base area 711 has been enlarged in the last processing (YES at Step S222), so the base area 712 is shrunk by a specified amount from the boundary line in the direction away from the base area 711 (Step S225). Note that in the present embodiment, the amount of the enlargement and the amount of the shrinking of the base area are both set to be the same specified distance from the boundary line. Next, the sewing data are created for forming the stitches in the shrunken base area 712 (Steps S209 to S211).

Figure 23:
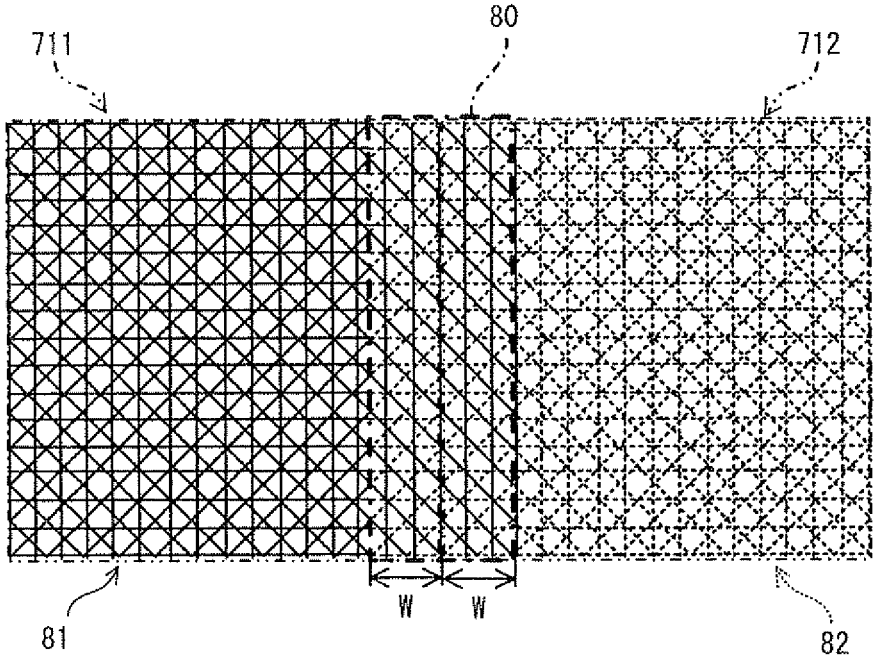
FIG. 23 is an explanatory figure of completed base stitches.

In the second layer to the fourth layer, the base areas 711, 712 are alternately enlarged or shrunk in the same manner, and the processing that creates the sewing data for forming the base stitches in the enlarged or shrunken base areas 711, 712 is repeated. More specifically, in the second layer, the base area 711 is shrunk, and the base area 712 is enlarged. In the third layer, the base area 711 is enlarged, and the base area 712 is shrunk. In the fourth layer, the base area 711 is shrunk, and the base area 712 is enlarged. The stitches that are described by the sewing data for the first to the fourth layers that are created by the overlap processing are shown in FIGS. 19 to 22, respectively. Note that the second stitches have been omitted from FIGS. 19 to 22. In addition, base stitch series 81, 82 that are made up of the stitches in the first to the fourth layers in the base areas 711, 712 are shown in FIG. 23. Note that the reference numerals 711, 712 in FIGS. 19 to 23 indicate the base areas 711, 712 before they are enlarged and shrunk, and the stitches in the base area 712 are indicated by broken lines in order to distinguish them from the stitches in the base area 711.

In the overlap processing in the second embodiment, the overlapping portion is not formed in any of the stitch layers, as shown in FIGS. 19 to 22. Instead, from the first layer to the fourth layer, the boundary line between the contiguous base areas 711, 712 moves alternately to the base area 712 side and the base area 711 side from its original position by a width W. Further, as shown in FIG. 23, in a case where the base stitch series 81, 82 are formed that are made up of the stitches in each of the four layers, an overlapping portion in which a portion of the base stitch series 81 and a portion of the base stitch series 82 intersect is formed in a region 80. The region 80 covers an area that extends on both sides of the original boundary line between the base areas 711, 712 by the width W.

The stitches in base stitch series 81 are formed in the region 80 only in the first layer and the third layer. Therefore, within the base area 711, there are two stitch layers in the region 80. The portion of the base area 711 outside of the region 80 is made up of four stitch layers. By the same token, the stitches in base stitch series 82 are formed in the region 80 only in the second layer and the fourth layer. Therefore, within the base area 712, there are two stitch layers in the region 80. The portion of the base area 712 outside of the region 80 is made up of four stitch layers. Therefore, the overlapping portion that is formed in the region 80 includes the first layer and the third layer of the base stitch series 81 and the second layer and the fourth layer of the base stitch series 82. Therefore, according to the overlap processing in the second embodiment, the entire region outside the overlapping portion of the base areas 711, 712 has the same thickness as the overlapping portion that is formed in the region 80. In this case, it is possible to avoid a situation in which more of the stitch layers are superposed in the overlapping portion than in the other portions, making only the overlapping portion thicker. Accordingly, the sewing data can be produced that result in beautiful stitches to be formed.

Figure 24:
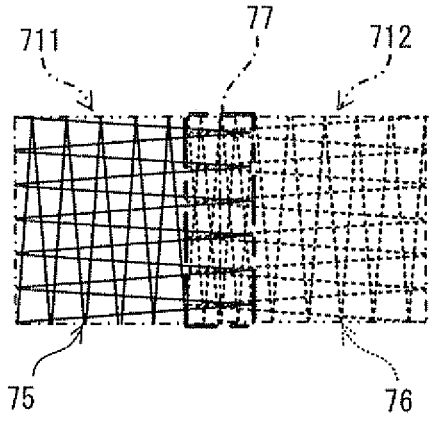
FIG. 24 is an explanatory figure of base stitches according to a modified example.

The present disclosure is not limited to the embodiments that are described above, and various types of modifications are possible. For example, the overlapping portion may also be formed by any other method, as long as a region is formed in which a portion of the base stitches that are formed in one of the two contiguous base areas intersect or overlap with a portion of the base stitches that are formed in the other base area. However, the base stitches that are formed in the base areas need to include a plurality of locations where two stitches that extend in different directions intersect. In the embodiments that are described above, the same stitching direction is used in both of the two contiguous base areas within any one layer, but different stitching directions may also be used within any one layer. For example, as shown in FIG. 24, an overlapping portion 77 where portions of base stitch series 75, 76 intersect can be formed by forming the base stitch series 75, 76 such that two zigzag-shaped stitch layers that orthogonally intersect are superposed in the base areas 711, 712, which are enlarged in the same manner as in the first embodiment.

Figure 25:
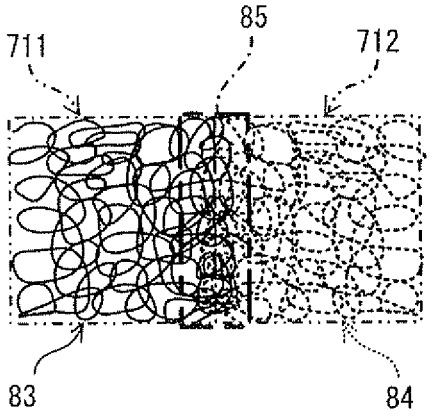
FIG. 25 is an explanatory figure of base stitches according to a different modified example.

It is also not necessary for the base stitches to be formed by a plurality of layers, and a single layer of stitches is may be employed. For example, as shown in FIG. 25, base stitch series 83, 84 may be formed on lines that are combinations of intersecting curved lines. In this case as well, the forming of the base stitch series 83, 84 in the enlarged base areas 711, 712 makes it possible to form an overlapping portion 85 in which portions of the base stitch series 83, 84 intersect or overlap.

The overlap processing in the first embodiment (refer to FIG. 5) is an example in which both of the two contiguous base areas are enlarged, and the overlap processing in the second embodiment (refer to FIG. 18) is an example in which the two contiguous base areas are alternately enlarged and shrunk. In addition, it is acceptable for only one of the two contiguous base areas always to be enlarged and for the two contiguous base areas to be alternately enlarged. In other words, it is acceptable as long as the overlapping portion can be formed by enlarging at least one of the two contiguous base areas and forming the base stitches.

In the embodiments that are described above, the direction that intersects the tangent line for the boundary line is defined as the stitching direction for the first layer, and the relationship to the tangent line is not taken into consideration for the other layers. However, the stitching directions for all of the stitch layers may also be defined as directions that intersect the tangent line direction. In that case, if the stitching direction that is set at Step S209 in the overlap processing in FIG. 5 does not intersect the direction of the tangent line that was specified at Step S203, for example, processing may be performed that modifies the stitching direction. A line that is orthogonal to the tangent line at a point on the boundary line may also be derived, and the direction of the orthogonal line may be used for the stitching direction. The point that is specified on the boundary line may also be a plurality of the points. For example, in a case where the boundary line is a curved line, a plurality of characteristic points on the curved line may be specified, and the directions of lines that are orthogonal to the tangent lines at the various points may be used in order as the stitching directions in a plurality of stitch layers.

It is also not necessary for the direction that intersects the tangent line of the boundary line to be defined as the stitching direction for the first layer, as it is in the embodiments that are described above. In a case where the base stitches are formed by the superposing of the plurality of the stitch layers, it is preferable for the stitching direction of at least one layer among the plurality of the stitch layers to intersect the tangent line of the boundary line. However, the stitching directions of all of the stitch layers may also be substantially parallel to the tangent line of the boundary line. In other words, it is acceptable for the processing at Steps S202 to S204 of the overlap processing (FIGS. 5 and 18) not to be performed.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing data creation apparatus, comprising:

an area specification portion that specifies at least one area in which a plurality of stitches are to be formed, each of the at least one area including a plurality of locations where two stitches that extend in different directions intersect; and a sewing data creation portion that creates sewing data for forming the plurality of stitches in each of the at least one area specified by the area specification portion, the sewing data creation portion creating sewing data for forming an overlapping portion in a case where the at least one area specified by the area specification portion includes a first area and a second area, the first area and the second area being two areas that are contiguous and that are to be sewn with different types of threads, the overlapping portion being a region in which at least one of the first area and the second area is enlarged in a direction that extends across a boundary line between the first area and the second area, such that a portion of the plurality of stitches to be formed in the first area is one of intersected and overlapped by a portion of the plurality of stitches to be formed in the second area, wherein the plurality of stitches to be formed in each of the first area and the second area include a plurality of stitch layers, each of the plurality of stitch layers including a plurality of first stitches and a plurality of second stitches, the plurality of first stitches being a plurality of stitches for which a stitching direction is the same, the plurality of second stitches being a plurality of stitches that link the plurality of first stitches, the stitching direction being different in each of the plurality of stitch layers, and the overlapping portion is formed such that the stitching direction of at least one of the plurality of stitch layers in the first area is substantially parallel to the stitching direction of at least one of the plurality of stitch layers in the second area, and at least a portion of the plurality of stitches included in the at least one of the plurality of stitch layers in the first area one of intersects and overlaps with at least a portion of the plurality of stitches included in the at least one of the plurality of stitch layers in the second area.

2. The sewing data creation apparatus according to claim 1, further comprising:

a specified point setting portion that specifies a point on the boundary line between the first area and the second area, wherein the sewing data creation portion creates the sewing data for forming the overlapping portion in which both the stitching direction of at least one of the plurality of stitch layers in the first area and the stitching direction of at least one of the plurality of stitch layers in the second area intersect a line that is tangent to the boundary line at the point specified on the boundary line.

3. The sewing data creation apparatus according to claim 1, wherein the overlapping portion includes the same number of stitch layers as the plurality of stitch layers included in the plurality of stitches.

4. A computer program product stored on a non-transitory computer-readable medium, comprising instructions for causing a processor of a sewing data creation apparatus to perform the steps of:

specifying at least one area in which a plurality of stitches are to be formed, each of the at least one area including a plurality of locations where two stitches that extend in different directions intersect; and creating sewing data for forming the plurality of stitches in each of the specified at least one area and for forming an overlapping portion in a case where the specified at least one area includes a first area and a second area, the first area and the second area being two areas that are contiguous and that are to be sewn with different types of threads, the overlapping portion being a region in which at least one of the first area and the second area is enlarged in a direction that extends across a boundary line between the first area and the second area, such that a portion of the plurality of stitches to be formed in the first area is one of intersected and overlapped by a portion of the plurality of stitches to be formed in the second area, wherein the plurality of stitches to be formed in each of the first area and the second area include a plurality of stitch layers, each of the plurality of stitch layers including a plurality of first stitches and a plurality of second stitches, the plurality of first stitches being a plurality of stitches for which a stitching direction is the same, the plurality of second stitches being a plurality of stitches that link the plurality of first stitches, and the stitching direction being different in each of the plurality of stitch layers, and the overlapping portion is formed such that the stitching direction of at least one of the plurality of stitch layers in the first area is substantially parallel to the stitching direction of at least one of the plurality of stitch layers in the second area, and at least a portion of the plurality of stitches included in the at least one of the plurality of stitch layers in the first area one of intersects and overlaps with at least a portion of the plurality of stitches included in the at least one of the plurality of stitch layers in the second area.

5. The computer program product stored on a non-transitory computer-readable medium, according to claim 4, further comprising instructions that cause the processor to perform the step of:

specifying a point on the boundary line between the first area and the second area, wherein creating the sewing data for forming the overlapping portion in which both the stitching direction of at least one of the plurality of stitch layers in the first area and the stitching direction of at least one of the plurality of stitch layers in the second area intersect a line that is tangent to the boundary line at the point specified on the boundary line.

6. The computer program product stored on a non-transitory computer-readable medium, according to claim 4, wherein the overlapping portion includes the same number of stitch layers as the plurality of stitch layers included in the plurality of stitches.

7. A sewing data creation apparatus, comprising:

a processor; and a memory configured to store computer-readable instructions that, when executed, cause the processor to perform processes comprising:

specifying an area in which a plurality of stitches are to be formed, the area including a plurality of locations where two stitches that extend in different directions intersect, the area including a first area and a second area, the first area and the second area being two areas in which a plurality of stitches are to be sewn with different types of threads, and the first area and the second area being contiguous and not overlapping with each other;

enlarging at least one of the first area and the second area in a direction that extends across a boundary line between the first area and the second area, thereby forming an overlapping portion where a portion of the first area and a portion of the second area overlap with each other, wherein the at least one of the first area and the second area is enlarged; and creating sewing data for forming a plurality of stitches in each of the first area and the second area, wherein the at least one of the first area and the second area is enlarged, a portion of the plurality of stitches to be formed in the first area and a portion of the plurality of stitches to be formed in the second area being one of intersected and overlapped with each other in the overlapping portion.

* * * * *